United States Patent [19]

Nakamura et al.

[11] Patent Number: 5,008,601

[45] Date of Patent: Apr. 16, 1991

[54] MULTIFUNCTION SWITCHING CONTROL SYSTEM

[75] Inventors: Takashi Nakamura; Haruhiko Tanaka; Touru Hyodo; Yasuhiro Osanai, all of Tokyo, Japan

[73] Assignee: Janome Sewing Machine Company Limited, Tokyo, Japan

[21] Appl. No.: 503,324

[22] Filed: Apr. 2, 1990

[30] Foreign Application Priority Data

Mar. 31, 1989 [JP] Japan ..... 1-78056

[51] Int. Cl.[5] ..... H02P 7/00; D05B 69/26

[52] U.S. Cl. ..... 318/268; 318/272; 112/275; 112/277

[58] Field of Search ..... 318/256, 257, 264, 268, 318/269, 272, 275, 277, 278, 279, 567; 112/275, 277, 455, 271, 274

[56] References Cited

U.S. PATENT DOCUMENTS

| | | | |
|---|---|---|---|
| 3,100,554 | 8/1963 | Doubek | 318/269 X |
| 3,582,748 | 6/1971 | Kato . | |
| 3,597,772 | 8/1971 | Seesselberg | 318/269 |
| 4,090,664 | 5/1978 | Elderkin | 318/599 X |
| 4,139,808 | 2/1979 | Matsumura | 318/269 |
| 4,501,210 | 2/1985 | Hanyu et al. . | |
| 4,739,232 | 4/1988 | Ishimoto | 318/473 |
| 4,920,304 | 4/1990 | Antonowitz | 318/266 X |

*Primary Examiner*—Bentsu Ro

*Attorney, Agent, or Firm*—Frishauf, Holtz, Goodman & Woodward

[57] ABSTRACT

A multifunction switching control system includes: a sewing speed controller of a computerized sewing machine controlled in response to a voltage of a sliding terminal of a variable resistor incorporated in the controller; an invariable resistor; a first A/D converter for converting the voltage from an analog signal to a first digital signal; and a second A/D converter for converting a voltage at a fixed terminal of the variable resistor from an analog signal to a second digital signal. A switch circuit for directly connecting one terminal of the invariable resistor to the fixed terminal of the variable resistor is provided in the controller. By comparing the second digital signal with a preset value, it is determined whether or not the switch circuit is so operated. In case that the switch circuit is so operated, sewing operation other than sewing speed controls of the machine are conducted.

5 Claims, 4 Drawing Sheets

MULTIFUNCTION SWITCHING CONTROL SYSTEM

BACKGROUND OF THE INVENTION

1. Field of the Invention

The present invention relates to a multifunction switching control system of an electronic sewing machine controlled by a microcomputer.

2. Description of the Prior Art

Hitherto, in a conventional electronic sewing machine such as computerized sewing machines, function selection switches or function keys are provided in a sewing machine. In operation, the user depresses any one of the function keys to realize function selection of the machine so as to perform any of reverse stitching operation, start/stop operation, swing amplitude manual control operation and the like.

However, in case that function selection of such conventional sewing machine is conducted during sewing operation of the machine, it is necessary for the user to temporarily transfer his attention from a workpiece stitch to the sewing machine during such sewing operation. As a result, the sewing operation is considerably disturbed. Further, in this case, there is a fear that the user injures his hand holding the workpiece or cloth by a sewing needle of the machine.

In order to resolve the above problem, function selection switches or function keys are provided in a controller in some of the conventional sewing machines. In this case, it is necessary to additionally provide a lead wire for transmitting a switching signal from the controller to the sewing machine, because the switching signal is issued from the function selection switches or function keys of the controller. However, such additional lead wire will make it necessary to employ a multiple-wire system in a cable which connects the controller to the sewing machine. This is another problem inherent in the conventional sewing machine.

SUMMARY OF THE INVENTION

It is an object of the present invention to provide a multi-function switching control system of an electronic sewing machine controlled by a microcomputer, which sewing control system realizes a safety sewing operation by providing function selection switches or function keys in a controller of the machine without employing a multiple-wire system in a cable which connects the controller to a sewing machine.

The above object of the present invention is accomplished by providing a first embodiment of the present invention, namely:

In a multifunction switching control system comprising: a sewing speed controller for controlling a sewing speed of a computerized sewing machine by setting a voltage value of a variable resistor incorporated in said sewing speed controller; an invariable resistor; a first A/D converter for converting the set voltage value of the variable resistor from an analog signal to digital signal; and a second A/D converter for converting a voltage value of a junction point between the variable resistor and the invariable resistor from an analog signal to a digital signal;

an improvement comprising:

(a) a switch circuit opearted to shortcircuit the opposite terminal of said variable resistor;

(b) a comparator having a reference value stored therein and detecting if said switch circuit is shortcircuited or not by comparing the converted digtal value of said second A/D converter with said reference value stored in said comparator, said comparator causing said sewing speed controller to be capable of operating functional parts of said sewing machine other than said sewing speed control thereof;

in case said switch circuit is operated to shortcircuit said opposite terminal of said variable resistor.

The above object of the present invention is also accomplished by providing a second embodiment of the present invention, namely:

in a multifunction switching control system comprising: a sewing speed controller for controlling a sewing speed of a computerized sewing machine by setting a voltage value of a variable resistor, incorporated in said sewing speed controller; an invariable resistor connected in series with the variable resistor; a first A/D converter for converting the set voltage value of the variable resistor from an analog signal to digital signal; and a second A/D converter for converting a voltage value of a junction point between the variable resistor and the invariable resistor from an analog signal to a digital signal;

an improvement comprising:

(a) a constant-voltage circuit connectable to said variable resistor;

(b) a switch circuit operated to connect said constant-voltage circuit to said variable resistor in parallel;

(c) a comparator having a reference value stored therein and detecting if said constant-voltage circuit is connected to said variable circuit in parallel or not by comparing said converted digital value of said second A/D converter with the reference value of the comparator, said comparator causing said sewing speed controller to be capable of operating functional parts of said sewing machine other than said speed control thereof.

The above object, additional objects, additional embodiments and advantages of the present invention will be clarified to those skilled in the art hereinbelow with reference to the following description and the accompanying drawings illustrating preferred embodiments of the present invention according to the principles of the present invention.

BRIEF DESCRIPTION OF THE DRAWINGS

FIG. 5(*b*) is a partially broken perspective view of the controller of the multifunction switching control system of the present invention.

DESCRIPTION OF THE PREFERRED EMBODIMENTS

Hereinbelow, embodiments of the present invention will be described in detail with reference to the accompanying drawings.

Figure 1:
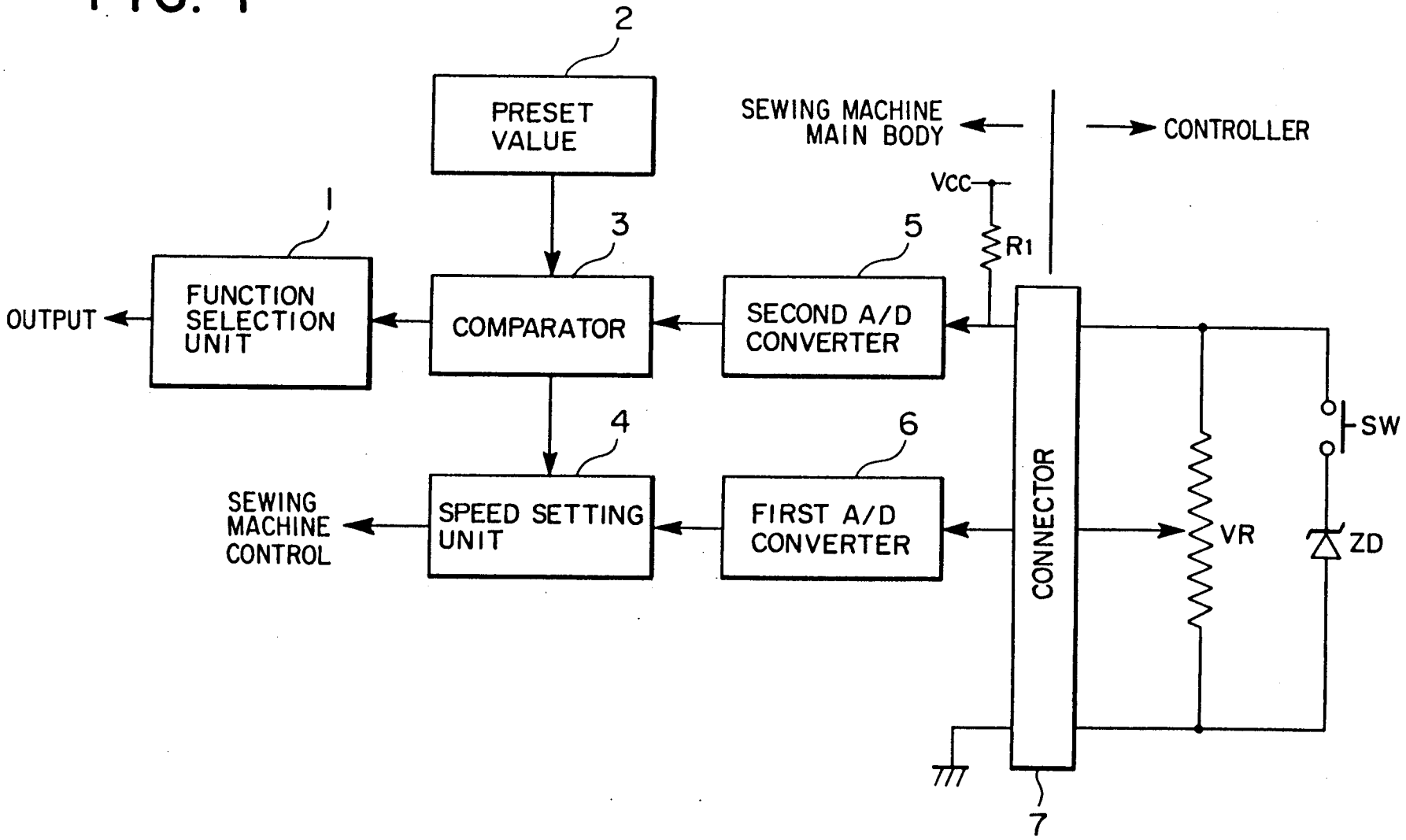
FIG. 1 is a block diagram of the multifunction switching control system of the present invention.

As shown in FIG. 1, in a sewing speed controller of a computerized sewing machine for controlling a sewing speed according to a voltage value determined by a position of sliding terminal of a variable resistor VR, one of opposite terminals of the variable resistor VR is connected to the the ground and the other of the opposite terminals is connected to an electric power source Vcc through a resistor $R_1$ which is connected in series with the variable resistor VR. A switch SW is incorporated in the controller, and connects the variable resistor VR in series with a constant voltage means such as a voltage regulation diode ZD or in series with an invariable resistor r. On the other hand, as is clear from FIG. 1 illustrating a block diagram of a multifunction switching control system of an electronic sewing machine of the present invention, a second A/D converter 5 for converting a voltage value of a junction point of the resistor $R_1$ and the variable resistor VR from an analog signal to a second digital signal is provided in the multifunction switching control system of the present invention. The thus converted second digital signal is issued from the second A/D converter 5 to a comparator 3. In a condition in which the switch SW is turned off, a magnitude of the second digital signal is equal to a value of:

$$(Vcc \times RVR)/(RVR+R_1)$$

where: R VR is a resistance value of the variable resistor VR; and $R_1$ is a resistance value of the resistor $R_1$.

In the comparator 3, the second digital signal is compared with a preset value 2. In case that the second digital signal is coincident in magnitude with the preset value 2, normal sewing speed controls are conducted.

In case that the switch SW is turned on to connect the voltage regulation diode ZD in parallel with the variable resistor VR, the second digital signal is equal in magnitude to a voltage V ZD of the voltage regulation diode ZD. On the other hand, in case that the switch SW is turned on to connect the invariable resistor r in parallel with the variable resistor VR, the second digital signal is equal in magnitude to a value of:

$$\frac{(Vcc \times R\ VR \times R\ r)/(R\ VR + R\ r)}{(R_1 + R\ VR \times R\ r)/(R\ VR + R\ r)}$$

where: R r is a resistance value of the invariable resistor r.

Consequently, by employing one of the voltage regulation diode ZD and the invariable resistor r which make the second digital signal different in magnitude from the preset value 2, it is possible for the comparator 3 to detect whether or not the switch SW is turned on, a switching data signal is issued from the comparator 3 to a function selection unit 1 which in turn, according to the switching data signal, permits the sewing machine to operate in a suitable mode such as a reverse stitching mode, swing amplitude manual control mode and the like mode except a sewing speed setting mode.

In addition, as is clear from FIG. 1, the switching data signal is also issued from the comparator 3 to a sewing speed setting unit 4 in which: a first digital signal issued from a first A/D converter 6 is multiplied by a ratio of the second digital signal to the preset value 2 so as to compensate the first digital signal issued from the first A/D converter 6, whereby the substantially same sewing speed as that realized in a condition in which the switch SW is still not turned on is reset.

Now, an embodiment of the present invention shown in FIG. 2 will be described in detail.

Figure 2:
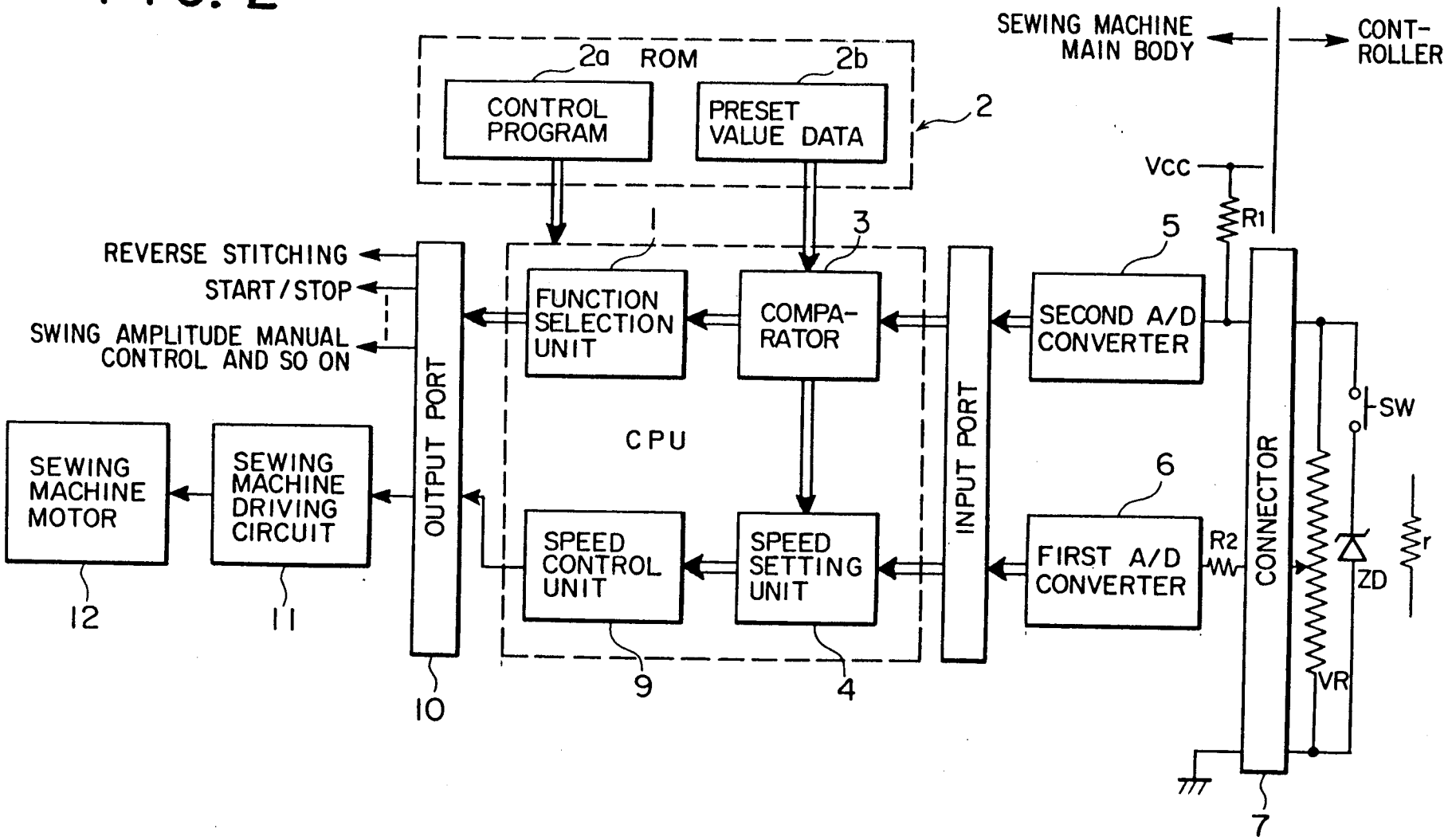
FIG. 2 is a block diagram an embodiment of the multifunction switching control system of the present invention.

As shown in FIG. 2, the sewing machine main body of the machine is connected with the controller through a connector 7. In the controller is provided the variable resistor VR for controlling a sewing speed of the machine. One of the opposite terminals of the variable resistor VR is connected to the ground, and the other of the opposite terminals of the variable resistor VR is connected with the electric power source Vcc through a resistor $R_1$ which is connected in series with the variable resistor VR. A sliding terminal of the variable resistor VR is connected with the first A/D converter 6 in which an analog signal is converted to the first digital signal which is issued from the first A/D converter 6 to the sewing speed setting unit 4 through an input port 8 of a central processing unit (CPU). Then, the sewing speed setting unit 4 issues a speed-setting signal to a sewing speed control unit 9, which speed-setting signal corresponds to the first digital signal issued from the first A/D converter 6. As a result, the sewing speed control unit 9 controls a sewing machine motor 12 through an output port 10 and a sewing machine driving circuit 11 to keep a sewing speed of the machine at a preset speed.

The present invention resides in the addition of the following functions to the above conventional computerized sewing machine a sewing speed of which is determined according to a voltage value determined by a position of the sliding terminal of the variable resistor VR.

In the present invention, the switch SW is employed to connect the voltage regulation diode ZD or the invariable resistor r in parallel with the variable resistor VR. First, hereinbelow, a condition in which the voltage regulation diode ZD is connected in parallel with the variable resistor VR will be described.

When the switch SW is turned on, a voltage value at a junction point of the invariable resistor r and the variable resistor VR becomes equal to the voltage V ZD of the voltage regulation diode ZD. The second A/D converter 5 receives the voltage V ZD to convert the same from an analog signal to the second digital signal which is issued from the second A/D converter 5 to the comparator 3 through the input port 8 of the central provrssing unit (CPU).

In the comparator 3, a preset value V VR stored in a read only memory (ROM) 2 is compared with the second digital signal issued from the second A/D converter 5 so as to detect whether or not the switch SW is turned on, the preset value V VR being equal in magnitude to a value of:

$$(Vcc+RVR)/(R_1+RVR).$$

When the comparator 3 detects that the switch SW is turned on, the second digital signal issued from the second A/D converter 5 is issued to the function selection unit 1. As a result, the function selection unit 1 permits the sewing machine to accomplish a function corresponding to the second digital signal. If necessary, the function selection unit 1 issues a control signal to an external circuit outside the central processing unit (CPU) through the output port of the CPU. The function described above is any one of a reverse stitching function, a swing amplitude manual control function of a sewing needle and the like function of the sewing machine.

In addition, when the comparator 3 detects that the switch SW is turned on, the comparator 3 issues its output signal to the sewing speed setting unit 4 in which the first digital signal issued from the first A/D converter 5 is multiplied by the ratio of the second digital signal to the preset value 2 to compensate the first digital signal issued from the first A/D converter 6, whereby the substantially sewing speed as that realized in a condition in which the switch SW is still not turned on is reset.

In a condition in which the switch SW is turned on, when it is not required to control a sewing speed of the machine, it is possible to accomplish the function selection by only employing a switching circuit for directly connecting the opposite terminals of the variable resistor VR. In this case, the voltage regulation diode ZD is eliminated, and it is possible for the user to operate the sewing machine at a predetermined sewing speed or at the substantially same sewing speed as that realized in a condition in which the switch SW is still not turned on.

Figure 3:
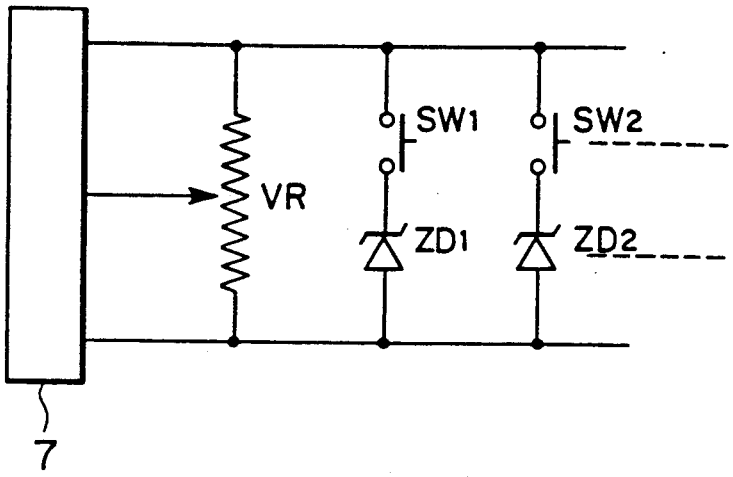
FIG. 3 is a first embodiment of a block diagram of a controller of the multifunction switching control system of the present invention.
Figure 4:
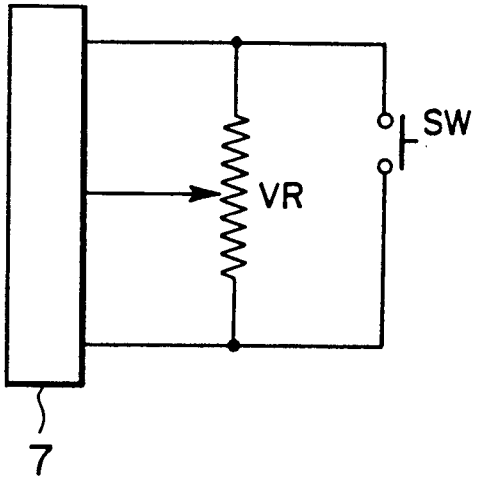
FIG. 4 is a second embodiment of the block diagram of the controller of the multifunction switching control system of the present invention.

In the above embodiment of the present invention, the number of the voltage regulation diode ZD or the invariable resistor r is one. However, it is also possible to employ a pluality of the voltage regulation diodes ZD or the invariable resistor r as shown in another embodiment of the present invention. In this case, as is clear from FIG. 3, a plurality of the voltage regulation diodes ZD which are different in voltage from each other are provided in the controller, any one of which diodes ZD is connected in parallel with the variable resistor VR by depressing or turning on a corresponding one of a plurality of the switches SW, whereby a desired function of the machine is selected by the user.

Figure 5A:
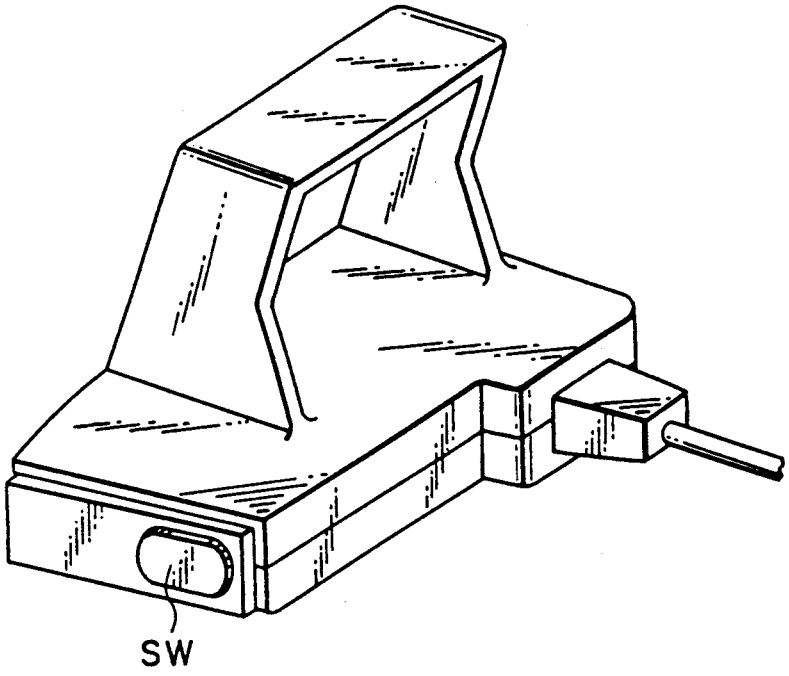
FIG. 5(*a*) is a perspective view of the controller of the multifunction switching control system of the present invention.
Figure 5B:
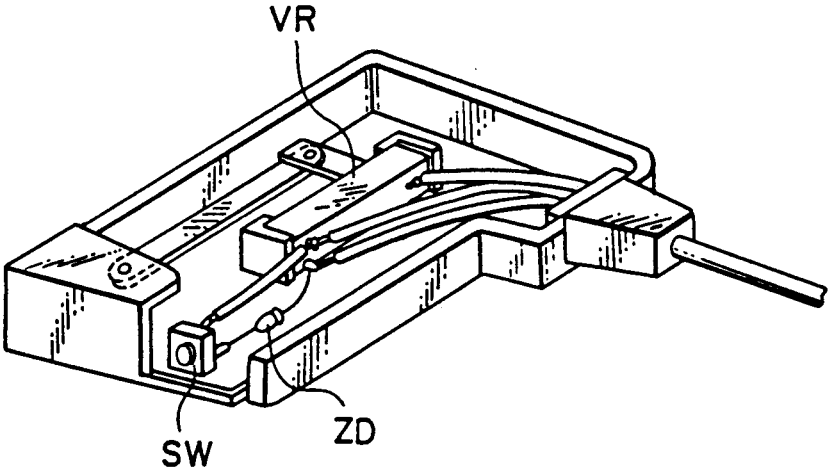

FIG. 5(*a*) is a perspective view of the controller of the present invention, and FIG. 5(*b*) is a partially broken perspective view of the controller of the present invention, illustrating the interior of the controller. In FIG. 5(*b*): the reference character VR denotes a variable resistor for controlling a sewing speed of the machine; ZD a voltage regulation diode; and SW a switch for connecting the voltage regulation diode ZD in parallel with the variable resistor VR.

As described above, according to the present invention, it is possible to provide the multifunction switching control system which enables the controller to have the function selection switches or function keys without employing the multiple-wire system in the cable which connects the sewing machine main body to the controller, whereby a safety sewing operation of the machine is ensured.

Since the above description refers to the preferred embodiments of the present invention, it should be understood that those skilled in the art could accomplish modifications within the scope of the present invention measured from the following claims.

What is claimed is:

1. In a multifunction switching control system for a sewing machine, comprising:

a sewing speed controller for controlling a sewing speed of a computerized sewing machine by setting a voltage value of a variable resistor incorporated in said sewing speed controller;

said variable resistor having a ground terminal, a variable terminal and a fixed terminal;

an invariable resistor;

a first A/D converter for converting the set voltage value of the variable resistor, at the variable terminal, from an analog signal to a digital signal; and a second A/D converter for converting a voltage value, at the fixed terminal of the variable resistor, from an analog signal to a digital signal;

the improvement comprising:

(a) a switch circuit operated to connect one terminal of the variable resistor to the fixed terminal of said variable resistor; and (b) a comparator having a reference value stored therein for detecting a connection of said switch circuit by comparing the converted digital signal of said second A/D converter with said stored reference value, said comparator causing said sewing speed controller to operate functional parts of said sewing machine other than said sewing speed control if said switch circuit is connected.

2. In a multifunction switch control system for a sewing machine, comprising;

a sewing speed controller for controlling a sewing speed of a computerized sewing machine by setting a voltage value of a variable resistor, incorporated in said sewing speed controller;

said variable resistor having a ground terminal, a variable terminal and a fixed terminal;

an invariable resistor connected in series with the variable resistor;

a first A/D converter for converting the set voltage value of the variable resistor from an analog signal to a digital signal; and a second A/D converter for converting a voltage value, at the fixed terminal of the variable resistor, from an analog signal to a digital signal;

the improvement comprising:

(a) a constant-voltage circuit connectable to said variable resistor;

(b) a switch circuit operated to connect said constant-voltage circuit to said fixed terminal of said variable resistor;

(c) a comparator having a reference value stored therein for detecting if the connection of said constant-voltage circuit by comparing said converted digital signal of said second A/D converter with said stored reference value, said comparator causing said sewing speed controller to operate function parts of said sewing machine other than said speed control if said constant-voltage circuit is connected.

3. The improvement as defined in claim 2, further comprising means for adjusting a sewing speed control value by multiplying said converted digital signal of said first A/D converter by a ratio between said converted digital signal of said second A/D converter and said stored reference value.

4. The improvement as defined in claim 2, wherein said constant-voltage circuit includes a zener diode.

5. The improvement as defined in claim 2, wherein said constant voltage circuit includes an invariable resistor.

* * * * *